US006877545B1

(12) United States Patent
Parkerson

(10) Patent No.: US 6,877,545 B1
(45) Date of Patent: Apr. 12, 2005

(54) FOAM CORNICE BOARD

(76) Inventor: Donald L. Parkerson, 4873 Cedar Oak Way, Sarasota, FL (US) 34233

( * ) Notice: Subject to any disclaimer, the term of this patent is extended or adjusted under 35 U.S.C. 154(b) by 0 days.

(21) Appl. No.: 10/389,669

(22) Filed: Mar. 14, 2003

(51) Int. Cl.[7] ..... E04F 10/00

(52) U.S. Cl. ..... 160/38; 160/39; 160/327; 160/330

(58) Field of Search ..... 160/38, 19, 39, 160/327, 330, 405

(56) References Cited

U.S. PATENT DOCUMENTS

| | | | | | |
|---|---|---|---|---|---|
| 159,774 | A | * | 2/1875 | Sowle | 160/38 |
| 1,929,140 | A | * | 10/1933 | Gabel | 160/38 |
| 2,154,909 | A | * | 4/1939 | Lorentzen | 160/38 |
| 2,501,133 | A | * | 3/1950 | Levy | 160/39 |
| 4,661,391 | A | | 4/1987 | Schroder et al. | |
| 5,042,548 | A | | 8/1991 | Attal | |
| 5,042,549 | A | | 8/1991 | Roberts | |
| 5,505,245 | A | | 4/1996 | Badalamenti | |
| 5,661,936 | A | * | 9/1997 | Ellingson | 52/285.1 |
| 6,152,204 | A | * | 11/2000 | Santoro | 160/38 |
| 6,173,752 | B1 | | 1/2001 | Nelson et al. | |
| 6,234,233 | B1 | * | 5/2001 | Biro | 160/38 |
| 6,315,026 | B1 | | 11/2001 | Ross | |

OTHER PUBLICATIONS

Decorative Cornices—Renaissance Collection Discount Decorating Center Brochure—Inventor's Company.

* cited by examiner

*Primary Examiner*—Bruce A. Lev
(74) *Attorney, Agent, or Firm*—Gifford, Krass, Groh, Sprinkle, Anderson & Citkowski, P.C.

(57) ABSTRACT

A foam cornice board for hanging curtains including a foam body having a decorative front surface defining a flat central and decorative upper and lower portions. The central portion is configured to receive a flat strip of decorative material such as a single vertical blind panel. The foam body further includes a notch formed into its back surface along the upper edge for receiving a mounting member connected thereto. For longer spans, a decorative foam keystone connector panel joins two adjacent cornice boards together which are abutted in end-to-end fashion. A decorative foam side cascade with a coextensive side panel is connectable to a wall, the side cascade having an upper margin configured for mating supportive engagement with a lower margin of the cornice board.

5 Claims, 7 Drawing Sheets

G
E
K
D
18
27
C
B
62
26
24
56
16
F
J
15
52
W
54
L
58
12
22
50
10
60
20
28
64

FOAM CORNICE BOARD

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to decorative cornice boards and assemblies used to conceal a curtain rod from which hanging curtains descend and more particularly to a foam-constructed cornice board of unique configuration and decorative enhancements therefor.

2. Description of Related Art

Interior decorative structures and designs are well known in the construction and design of cornice boards which are attached to a ceiling or wall above a window or doorway for decoratively concealing the curtain rod or hanging vertical blinds support track and opening/closing mechanisms therefor. The following U.S. patents are known to applicant which are related to this narrow field of interior decor:

U.S. Pat. No. 5,042,548 to Attal

U.S. Pat. No. 5,042,549 to Roberts

U.S. Pat. No. 4,661,391 to Schroder et al.

U.S. Pat. No. 5,505,245 to Badalamenti

U.S. Pat. No. 6,173,752 to Nelson et al.

U.S. Pat. No. 6,315,026 to Ross

U.S. Pat. No. D454,646 to Bushnell et al.

Of particular interest is the Ross invention as disclosed in U.S. Pat. No. 6,315,026 which teaches a cornice box having outer panels which are made of foam and incorporating a metal strip channel adjacent the upper surface for a stronger connection to support bracketry.

The Schroeder reference in U.S. Pat. No. 4,661,391 also discloses a method of manufacturing molded bodies such as cornices from foam plastic material and further teaches the incorporation of a thin elastic heat-deformable film incorporated into the mold at manufacture.

A foam cornice window treatment shown in U.S. Pat. No. '245 by Badalamenti incorporates an elongated flat slat member for added support to the foam cornice and providing a strong means of attachment to a wall.

The window treatment crown invented by Roberts in U.S. Pat. No. '549 teaches another cornice board assembly formed of flat expanded plastic foam material incorporating a top dust board all joined together by a water-based cement.

Applicant has fabricated cornice boards from composite material such as various ornamental and flat wood sections, the end product having enlarged and forwardly extending ornamental portions and a recessed flat portion sized to receive a strip of vertical blind material having the same or coordinated texture and coloring to accompany the vertical blinds themselves. A copy of applicant's business brochure is also referenced.

The present invention goes beyond this prior art by providing a foam cornice board mold-formed as a unit having upper and lower portions extending along the entire length of each cornice board which incorporates ornamental of decorative designs. The center portion is preferably unornamental for receiving either a strip of fabric or vertical blind material selected to coordinate with the material selected for the vertical blinds or curtains themselves. This invention also preferably includes a center connector of a keystone type for joining or splicing two abutting cornice boards formed in accordance with this invention to accommodate longer spans of window or doorway widths and further may include side cascades which facilitate attachment of each outer end of the cornice board to a wall and also provide a dramatic decorative benefit.

BRIEF SUMMARY OF THE INVENTION

This invention is directed to a foam cornice board for hanging curtains including a foam body having a decorative front surface defining a flat central and decorative upper and lower portions. The central portion is configured to receive a flat strip of decorative material such as a single vertical blind panel. The foam body further includes a notch formed into its back surface along the upper edge for receiving a mounting member connected thereto. For longer spans, a decorative foam keystone connector or splice panel joins two adjacent cornice boards together which are abutted in end-to-end fashion. A decorative foam side cascade with a coextensive side panel is connectable to a wall, the side cascade having an upper margin configured for mating supportive engagement with a lower margin of the cornice board.

It is therefore an object of this invention to provide a foam cornice board having a front surface which is substantially nonporous when mold-formed as a unit.

Still another object of this invention is to provide a molded foam cornice board which incorporates virtually limitless options and variables for decorative effect.

Yet another object of this invention is to provide a foam cornice board mold formed as a unit and incorporating decorative upper and lower portions and a generally flat central portion sized to receive a strip of decorative fabric material or vertical blind material color and texture coordinated to that of the vertical blinds or curtains.

Still another object of this invention is to provide a molded foam cornice board assembly utilizing a central keystone-type connector or splice member as concealing and strengthening an abutting joint between adjacent lengths of cornice board for installations having a length greater than the typical length of a cornice board itself.

And yet another object of this invention is to provide a foam cornice board assembly incorporating end cascades also mold formed as a unit which serve to enhance attaching strength to a wall and also serve as a dramatic decorative enhancement.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
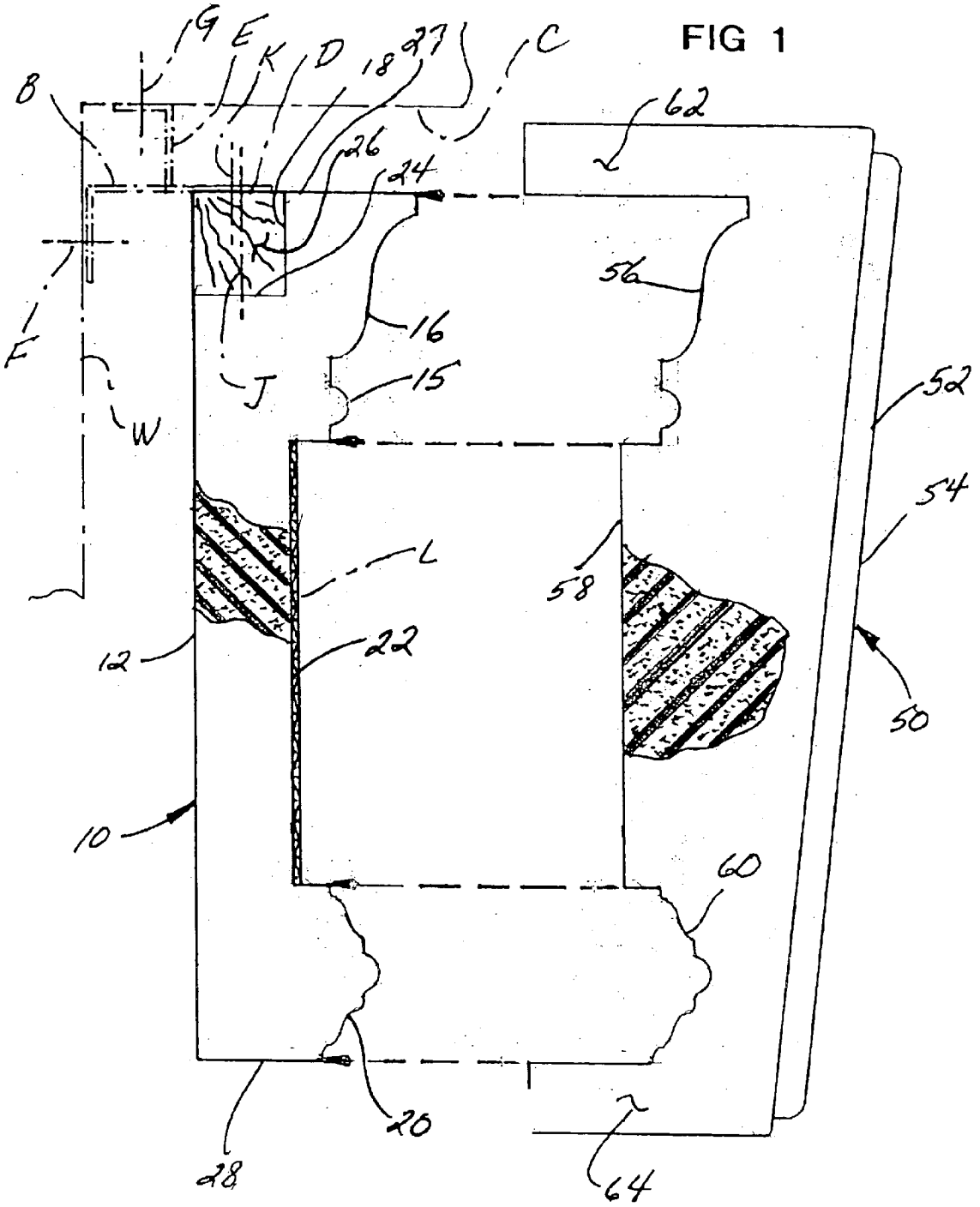
FIG. 1 is an exploded partially broken end elevation view of a typical foam cornice board in accordance with the present invention and also showing an optional central foam connector of the keystone-type in appearance aligned for installation to form a splice between adjacent abutting cornice boards.
Figure 2:
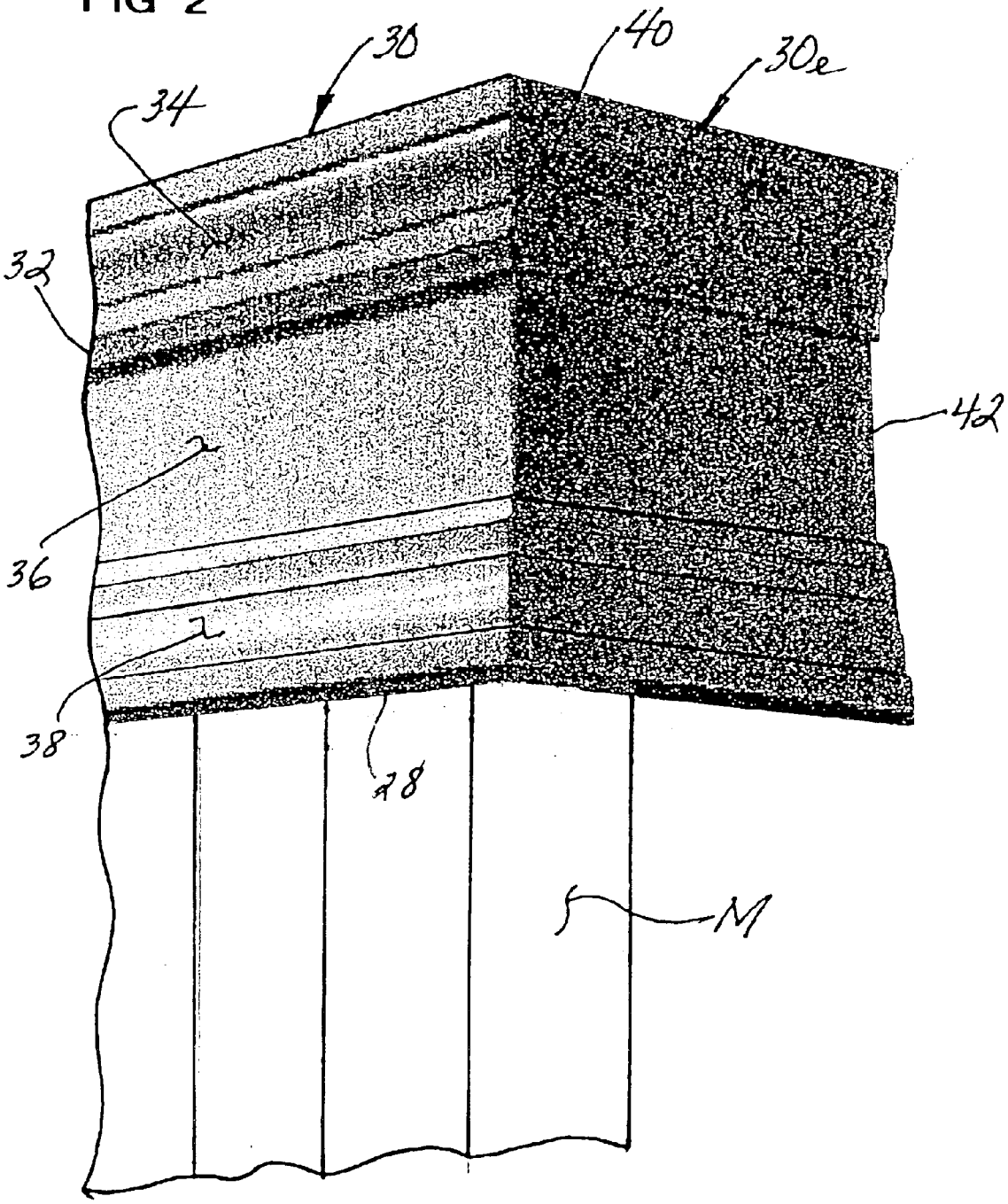
FIG. 2 is a perspective view of a corner portion of a cornice board assembly installation utilizing another decorative cornice board molded of foam material.
Figure 3:
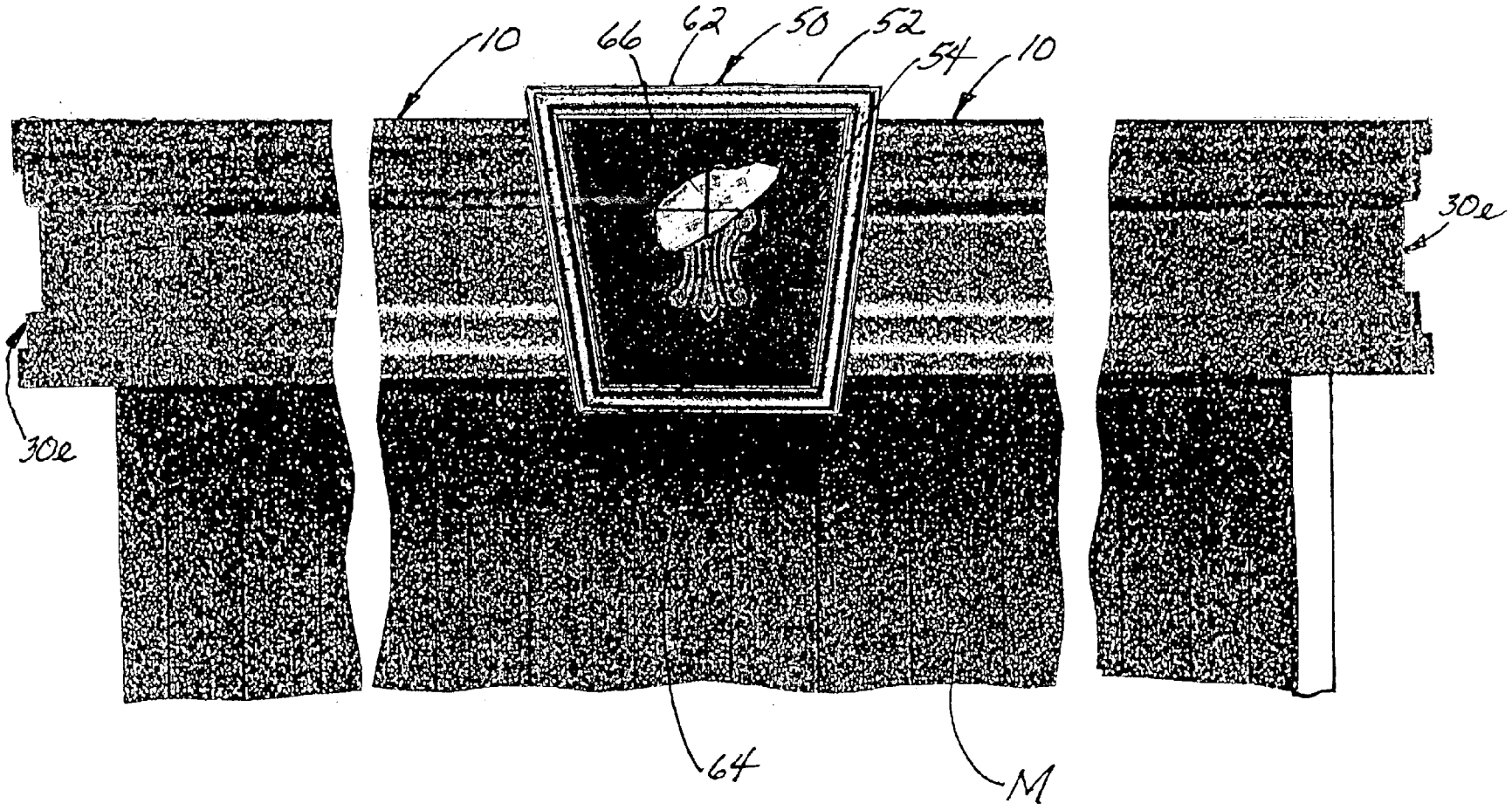
FIG. 3 is a front elevation view of a cornice board assembly installation depicting the central keystone-type connector therewith.
Figure 4:
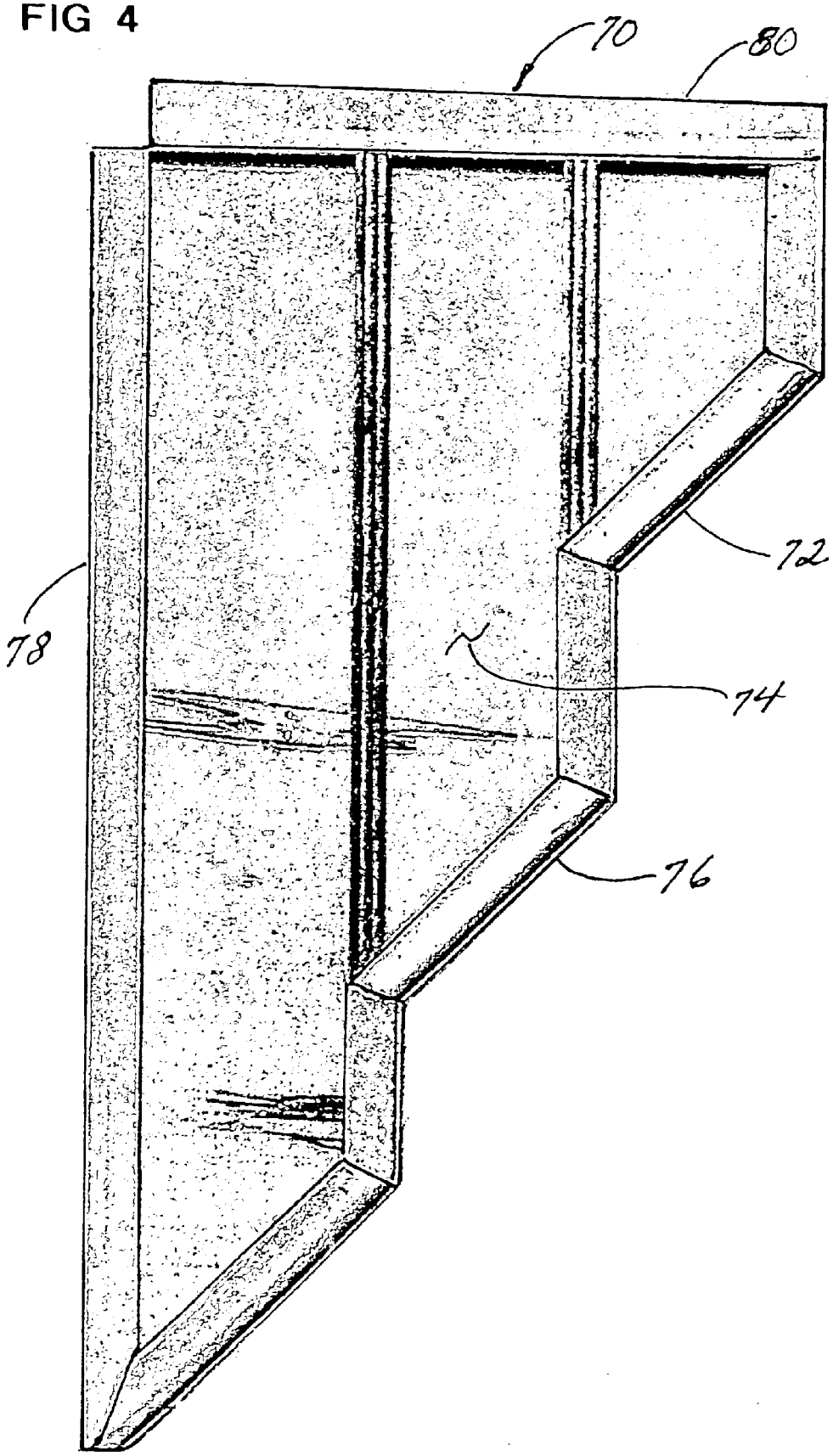
FIG. 4 is a front elevation view of a foam side cascade.
Figure 5:
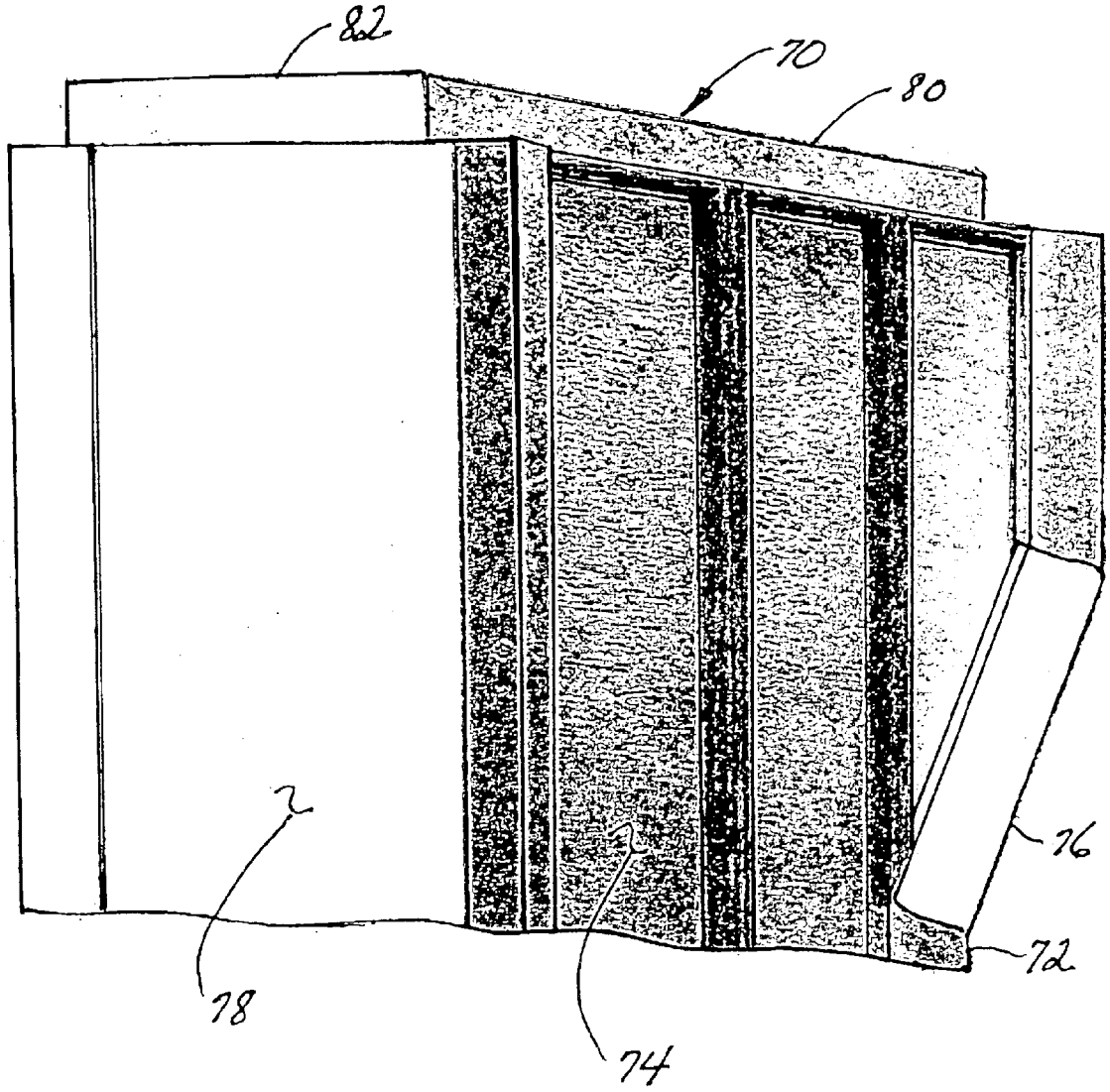
FIG. 5 is a front perspective view of the upper portion of the side cascade of FIG. 4.
Figure 6:
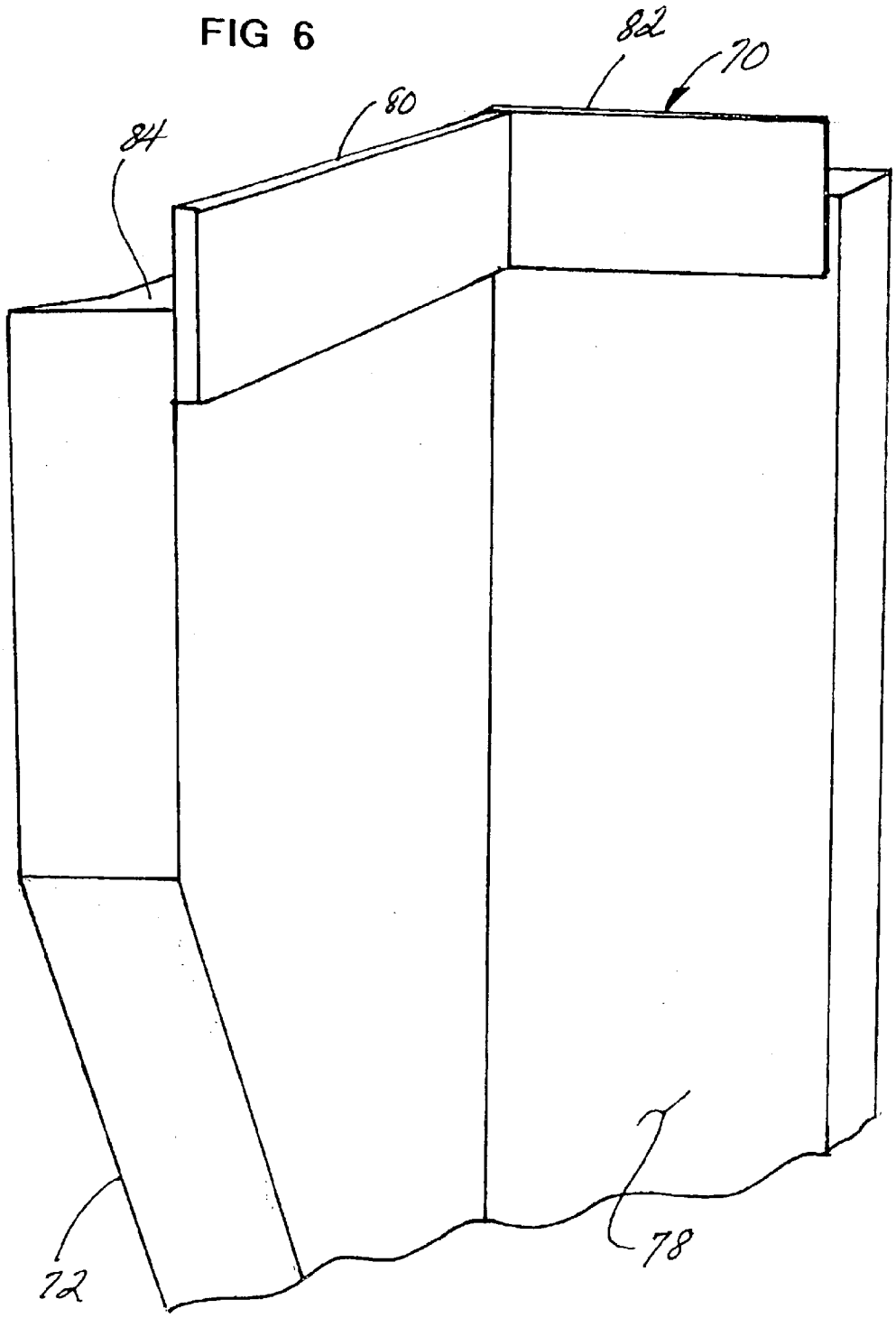
FIG. 6 is a rear perspective view of the upper portion of the side cascade of FIG. 4.

Referring now to the drawings, and particularly to FIGS. 1 to 3, one embodiment of a foam molded cornice board is shown generally at numeral 10. This cornice board 10 is formed as a unit and includes a generally flat back surface 12 having a notch 18 formed along the upper back margin thereof as shown.

The front facing decorative surface 15 generally includes a decorative upper portion 16, a decorative lower portion 20 and, positioned therebetween, a generally flat central portion 22. Thus, the cornice board 10 may be formed of substantially uniform or non-uniform cross sectional configurations as desired and in lengths suitable for mold forming foamed material.

MOLDING PROCESS

The mold forming process used to produce this foam cornice 10 begins with the fabrication of a pattern utilizing composite material such as wood, plastic and filler material to develop a pattern having the exact appearance and structural features, including overall size, as desired. Thereafter, a mold is fabricated of material suitable to mold form and contain a polyurethane foam and the chemical reaction produced thereby within the enclosed mold as it expands and becomes rigid. A polyurethane foam is selected from those which preferably produce the desired end product in a one step or one shot process. POLYOL, POLYISOCYANATE plus additives are carefully measured per the manufacturers formulation, continually mixed and then delivered into the mold.

It should be understood that the surfaces of the cornice board 10 are non-porous as a desirable byproduct utilizing molded polyurethane foam as above described to facilitate painting the front surface if desired.

Still referring to FIGS. 1 to 3, the notch 18 is sized to accommodate a length of 1" wood material forming a mounting member 26 thereby. Mechanical screws or nails are used at, for example, J into surface 24, to anchor the mounting member 26 into the notch 18. The cornice board 10 is then attached to the wall W by an L-shaped bracket B or to the ceiling C by a Z-shaped bracket E mechanically screwed at K into surface D of mounting member 26. Conventional fasteners at F or G effect attachment to the wall W or ceiling C respectively as desired.

As seen in FIG. 2, another decorative embodiment of the foam cornice board is shown there at numeral 30 including a main cornice board member 32 and an end portion 30*e*. The main cornice board member 32 also includes upper and lower decorative portions 34 and 38, respectively, and a central flat recess portion 36 sized to receive a length of the vertical blinds as shown hanging at M shown in the normally hung position from a curtain rod mechanism (not shown). An end portion 30*e* of the cornice board, attached by miter cutting and adhesion to the miter-cut end of the cornice board along upright joint 40 and attached to the wall at 42, is also provided for a finished decorative effect.

CONNECTOR PANEL

As seen in FIGS. 1 and 3, an installation of foam cornice boards 10 wherein the overall span across the vertical blinds M is longer than the length of one foam cornice board 10 itself, an upright seam or junction at 66 must be made to effect the installation. To help to conceal this junction or union of abutting end-to-end cornice boards 10 at 66, a connector panel of a keystone-type shown generally at numeral 50 is provided. This connector panel 50 is also mold formed as a unit of polyurethane foam material having a substantially nonporous exterior surface.

The front surface 54 of the molded panel body 52 has a decorative profile as desired. As best seen in FIG. 1, the rear or back surface 58 is mold formed to precisely mate against and surround the entire front surface including the upper, central and lower surface portions 16, 22 and 20, respectively. Thus, the back profile features at 56 and 60 substantially precisely mate over the front facing profile of cornice board 10 with top and bottom portions 62 and 64 closely mating against the top and bottom surfaces 27 and 28, respectively, of the cornice board 10. By this arrangement, the connector panel 50 serves, when mechanically fastened and/or adhered to mating end portions of abutted cornice boards, as both a decorative and a strong splicing member which also enhances the overall decorative effect of such a cornice board installation.

SIDE CASCADE

Referring now to FIGS. 4 to 7, a decorative side cascade is there shown generally at numeral 70. This side cascade 70 is also mold formed of polyurethane rigid foam material as a unit from a mold made from an exact pattern of the desired finished design of the side cascade 70.

Figure 7:
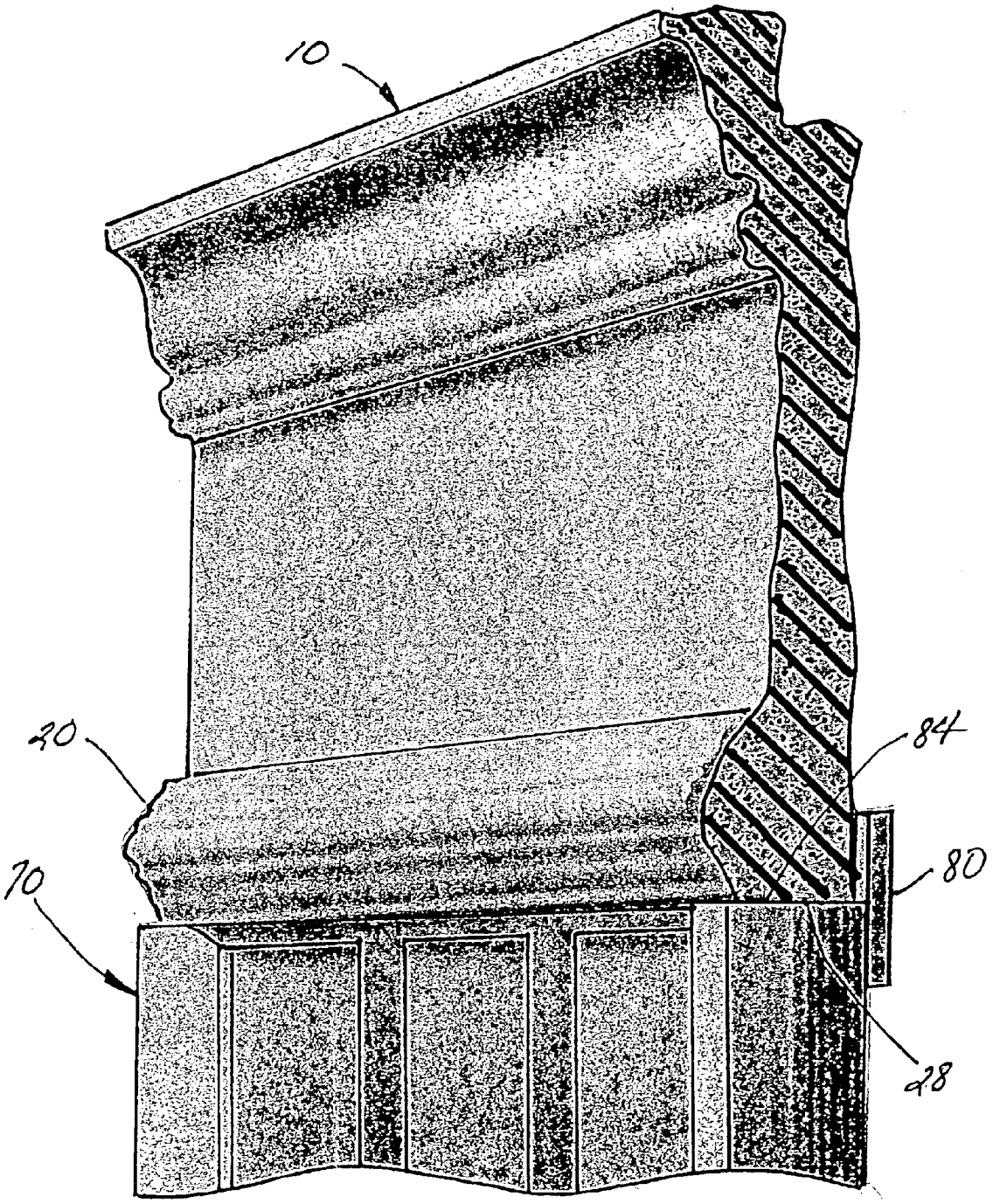
FIG. 7 is a broken front perspective view of the top portion of the side cascade of FIG. 4 showing a foam cornice board in place thereatop.

As seen in FIG. 7, one side cascade 70 is positioned immediately beneath each end of the cornice board 10 as seen in FIG. 1. The lower margin surface 28 rests directly atop the upper surface 84 of the side cascade 70. An integrally molded support strip 80 serves to both properly align the cornice board 10 and the top of the side cascade 70 and also provides attaching means enhanced by mechanical fasteners or adhesive as desired.

The front facing decorative surface 74 of the foam molded member 72 may be configured in a virtually limitless decorative profile, again formed by fabricating a pattern utilizing composite materials of wood and filler material and the like from which a mold is made for receiving and forming the foam polyurethane material into the rigid member 72.

The configuration of inner edge 76 is preferably formed having a cascade effect narrowing toward the lower or bottom portion of the side cascade 70. The outer upright edge 78 extends rearwardly by side panels 78, the upper margin of which also includes a support strip 82 for alignment and securement of a small segment of cornice board 10 to provide the same effect shown in FIG. 2.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A foam cornice board assembly for use with hanging curtains and a curtain rod assembly comprising:

an elongated substantially straight foam body molded as a unit and having a substantially non-porous decorative front surface defining upper, central and lower profile portions thereof;

said upper and lower profile portions extending forwardly from said central portion, said central portion being substantially flat and sized in width to substantially equal and closely align with each longitudinal margin of a flat strip of decorative material;

a second said foam;

a decorative foam keystone connector panel joining and supporting together said foam bodies which are abutted in end-to-end fashion, said connector having a decorative front surface and a rear surface which substantially self-aligns with and connectingly mates against the front surfaces of the abutting end portions of said foam bodies for support and alignment therebetween.

2. A foam cornice board as set forth in claim 1, further comprising:

a pair of decorative foam side cascades each having a decorative front surface and a side panel connectable to an upright support surface, each said side cascade also having an upper margin configured for mating supported engagement with a lower end margin of one said foam body and extending downwardly therefrom.

3. A foam cornice board assembly for use with hanging curtains and a curtain rod assembly, said cornice board assembly comprising:

two cornice boards each including an elongated substantially straight foam body molded as a unit and having a decorative front surface defining decorative upper, flat central and decorative lower profile portions thereof;

said upper and lower profile portions extending forwardly from said central portion, said central portion;

an elongated mounting member connected to each of said foam body and adapted for attachment to a ceiling or wall hanging bracket for support;

a decorative foam keystone connector panel joining said cornice board in abutting end-to-end fashion, said foam connector having a decorative front surface and a rear surface which substantially aligns with, connectingly mates against, and automatically aligns abutting end portions of the front surfaces of said cornice boards.

4. A foam cornice board as set forth in claim 3, further comprising:

a decorative foam elongated side cascade having a substantially non-porous decorative front surface and an orthogonally rearwardly extending generally coextensive wall side panel connectable to an upright support surface, said side cascade having an upper margin configured for mating supportive connection with a lower margin of and generally coplanar with said cornice board.

5. A foam cornice board as set forth in claim 3, further comprising:

a decorative elongated side cascade having a decorative front surface and a rearwardly extending side panel positionable against a wall surface, an upper margin of said side cascade connectable directly beneath and against a lower end margin of said cornice board, said cornice board having an inner edge having a cascade appearance narrowing downwardly toward a bottom portion thereof.

* * * * *